US012318672B1

(12) United States Patent
Esslinger

(10) Patent No.: US 12,318,672 B1
(45) Date of Patent: Jun. 3, 2025

(54) ROTATING GOLF TEE ASSEMBLY

(71) Applicant: Dan Esslinger, Whittier, CA (US)

(72) Inventor: Dan Esslinger, Whittier, CA (US)

( * ) Notice: Subject to any disclaimer, the term of this patent is extended or adjusted under 35 U.S.C. 154(b) by 0 days.

(21) Appl. No.: 18/435,830

(22) Filed: Feb. 7, 2024

Related U.S. Application Data

(60) Provisional application No. 63/444,621, filed on Feb. 10, 2023.

(51) Int. Cl.
*A63B 63/06* (2006.01)
*A63B 57/10* (2015.01)

(52) U.S. Cl.
CPC ..... *A63B 63/06* (2013.01); *A63B 57/10* (2015.10)

(58) Field of Classification Search
CPC ..... A63B 57/10; A63B 63/06; A63B 69/0075; A63B 69/0091
See application file for complete search history.

(56) References Cited

U.S. PATENT DOCUMENTS 1,976,405 A * 10/1934 Le Witt ..... A63B 69/0091 473/146
2,017,661 A * 10/1935 Johanson ..... A63B 69/0091 473/149
2,297,118 A * 9/1942 Wildegans ..... A63B 69/0091 473/149
2,818,255 A * 12/1957 Ponza ..... A63B 69/0091 473/146
3,643,961 A * 2/1972 Schroeder ..... A63B 69/0091 473/149
4,004,814 A * 1/1977 Blair ..... A63B 57/10 473/392
4,023,809 A * 5/1977 Newton ..... A63B 69/0091 473/146
4,809,988 A * 3/1989 Hunter ..... A63B 71/04 273/408
D306,627 S * 3/1990 Fox ..... D21/718
4,955,612 A * 9/1990 Tai ..... A63B 69/0091 473/149
5,275,406 A * 1/1994 Smagula ..... A63B 69/0091 473/146
5,672,118 A * 9/1997 Robbie ..... A63B 57/10 473/401
6,083,122 A * 7/2000 Brown ..... A63B 57/10 473/401
6,500,077 B1 * 12/2002 Wei ..... A63B 57/10 473/396
7,285,054 B1 * 10/2007 Morrision ..... A63B 71/06 473/149
9,757,638 B1 * 9/2017 Orfe ..... A63B 57/10

FOREIGN PATENT DOCUMENTS

DE 202010008341 U1 * 12/2010 ..... A63B 57/10
EP 0376846 A2 * 7/1990
GB 2230460 A * 10/1990 ..... A63B 69/0091

* cited by examiner

*Primary Examiner* — Steven B Wong

(57) ABSTRACT

Rotating golf tee devices are disclosed. The devices include a central base configured to be positioned on a ground surface. In addition, the devices include a motor that is connected to and located above the central base that rotates an axis perpendicular to the ground surface. The devices further include a plurality of arms extending from and connected, directly or indirectly, to the motor. The devices include a golf tee connected to the distal end of each of the plurality of arms, with the motor being configured to simultaneously rotate the plurality of arms and each connected golf tee.

11 Claims, 5 Drawing Sheets

ROTATING GOLF TEE ASSEMBLY

CROSS-REFERENCE TO RELATED APPLICATIONS

This application claims priority to, and incorporates by reference, U.S. provisional patent application Ser. No. 63/444,621, filed on Feb. 10, 2023.

FIELD OF THE INVENTION

The field of the present invention relates to golf and, more specifically, the present invention relates to rotating golf tee assemblies to be used for recreational and entertainment purposes.

BACKGROUND OF THE INVENTION

In recent years, golf has transcended traditional competitive and recreational formats into the field of entertainment. While local miniature golf venues have historically been the primary source of golf-related entertainment for novices, other businesses have recently emerged that have delivered entirely new golf-related entertainment formats, such as the multi-tiered and game-oriented driving ranges offered by TopGolf International, Inc. (Dallas, Texas). Indeed, these exciting new formats have made golf-related entertainment accessible and enjoyable for an even wider population. Although such new formats have been successful to date, this growing market would benefit from yet additional golf-related games that golf aficionados and novices alike would enjoy.

As the following will demonstrate, the rotating golf tee assemblies described herein are configured to address this growing market.

SUMMARY OF THE INVENTION

According to certain preferred aspects of the invention, rotating golf tee devices are provided, which are configured to be used for recreational and entertainment purposes. The devices comprise a central base that is configured to be positioned on a ground surface. In addition, the devices include a motor that is connected to and located above the central base. The motor is configured to rotate an axis that is perpendicular to the ground surface. The devices further comprise a plurality of arms that radially extend from and are connected, directly or indirectly, to the motor. The devices include a golf tee connected to the distal end of each of the plurality of arms, with the motor being configured to simultaneously rotate the plurality of arms and each connected golf tee.

According to certain specific aspects of the invention, the rotating golf tee devices preferably include an impact absorbing pad located beneath each golf tee, such impact absorbing pads may comprise synthetic grass. In addition, according to certain preferred aspects of the invention, each of the plurality of arms is connected, directly or indirectly, to the motor at a position that is elevated above a second position at which each golf tee is connected to the distal end of each of the plurality of arms. Still further, according to certain preferred aspects of the invention, the motor is configured to simultaneously rotate the plurality of arms and each golf tee connected to each of the plurality of arms at two or more speeds, with the rotating golf tee device being configured to allow a user to select the desired speed from the two or more speeds.

According to certain aspects of the invention, the rotating golf tee devices may further comprise a vacuum pump. The vacuum pump is pneumatically connected to a series of tubes, with each tube traveling along or within one of the plurality of arms and being pneumatically connected to the golf tee at the distal end of the applicable arm (such that each of the plurality of arms and associated golf tees are pneumatically connected to a tube that is pneumatically connected to the vacuum pump). The invention provides that the vacuum pump and series of tubes are configured to deliver a suction force to each golf tee, to assist in stabilizing a golf ball on the tee as the plurality of arms rotate. In addition, in such embodiments, the rotating golf tee devices may further include an accumulator chamber, which is configured to maintain a constant vacuum pressure (suction force) across all of the golf tees, even when one or more balls are missing from the tees (which would otherwise create a vacuum leak and affect the suction force being applied to the other golf tees).

As described herein, a user of the device may attempt to strike each golf ball as the device rotates (e.g., striking eight moving golf balls at a speed of, e.g., 1 revolution every 10 seconds, presents a fun challenge for golf aficionados and novices alike). The invention provides that the rotating golf tee devices may be used with conventional golf balls—and hit into a driving range, a golf net, a golf simulator, or other safe area. In other cases, the rotating golf tee devices may be used with golf balls comprised of plastic or foam/elastomers, such that the rotating golf tee devices may also be safely used in neighborhood settings.

The above-mentioned and additional features of the present invention are further illustrated in the Detailed Description contained herein.

DETAILED DESCRIPTION OF THE INVENTION

Figure 1:
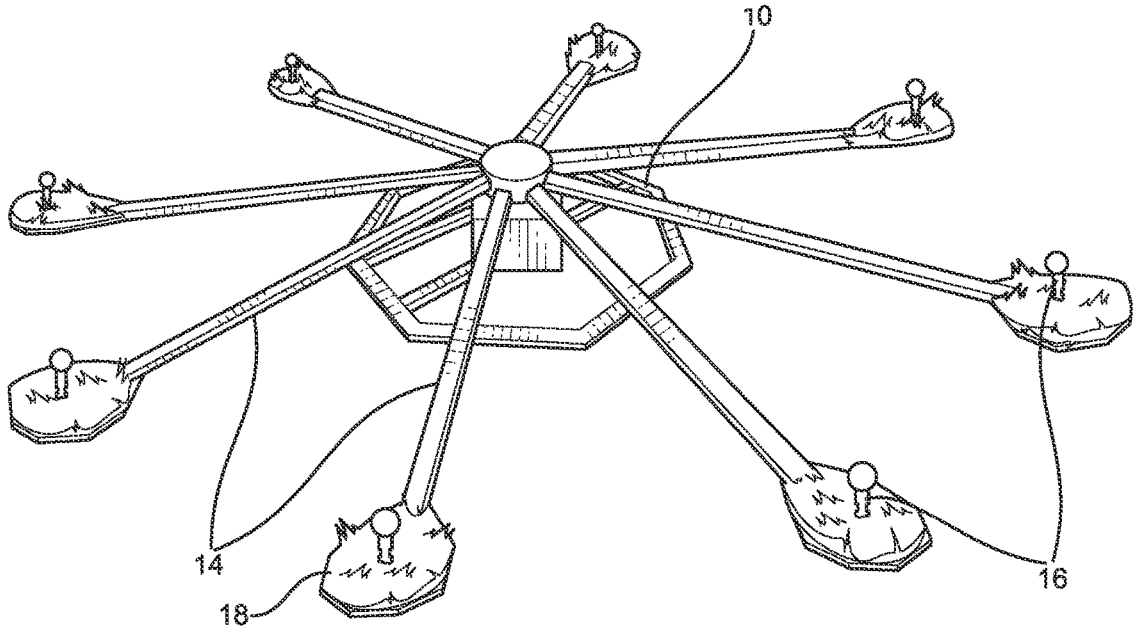
FIG. 1 is an elevated perspective view of the rotating golf tee assembly of the present invention.
Figure 2:
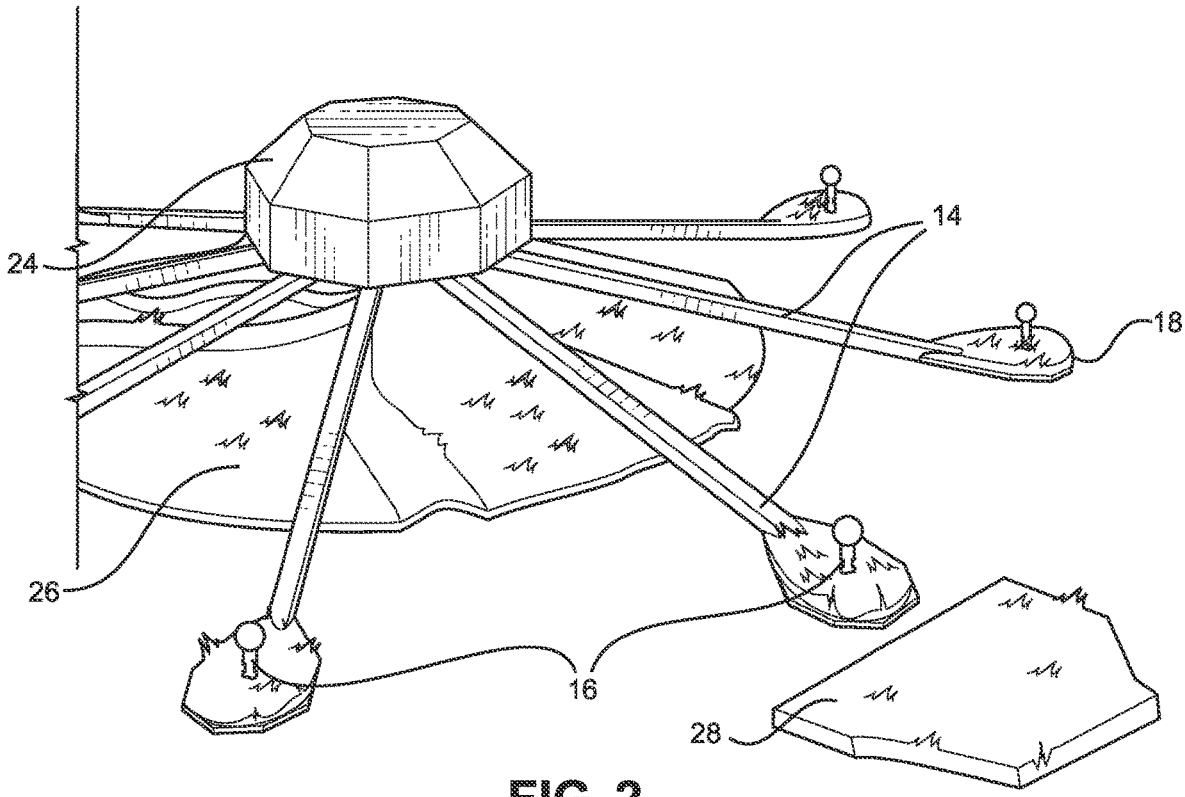
FIG. 2 is another elevated perspective view of the rotating golf tee assembly of the present invention.
Figure 3:
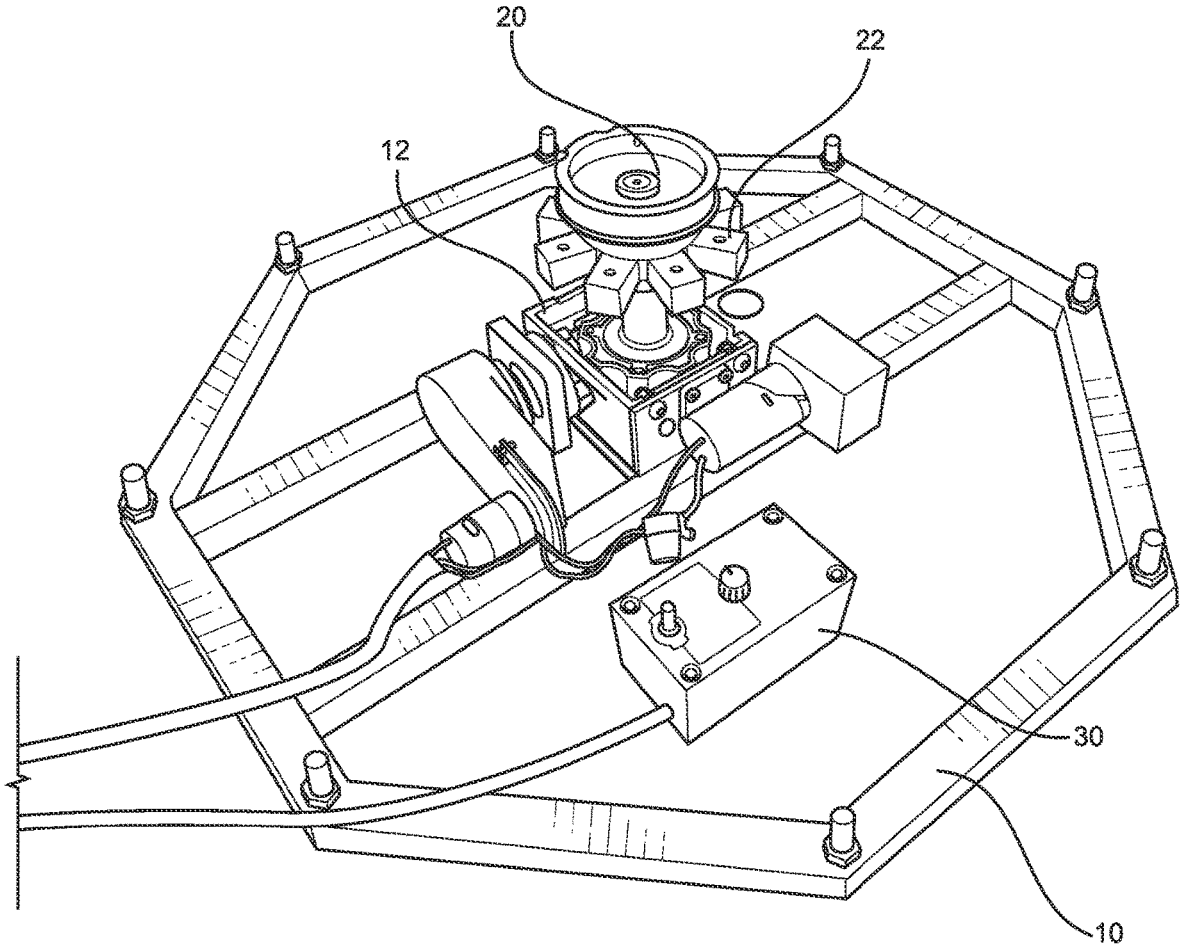
FIG. 3 is an elevated, perspective, disassembled view of the rotating golf tee assembly of the present invention.

The following will describe, in detail, several preferred embodiments of the present invention. These embodiments are provided by way of explanation only, and thus, should not unduly restrict the scope of the invention. In fact, those of ordinary skill in the art will appreciate upon reading the present specification and viewing the present drawings that the invention teaches many variations and modifications, and that numerous variations of the invention may be employed, used and made without departing from the scope and spirit of the invention.

Referring now to FIGS. 1-7, according to certain preferred embodiments of the invention, rotating golf tee devices are provided, which are configured to be used for recreational and entertainment purposes. The devices comprise a central base 10 that is configured to be positioned on a ground surface. The central base 10 is preferably a rigid structure, e.g., comprised of steel or another material exhibiting a sufficient weight and dimension to enable the device to remain stationary during operation. For example, the central base 10 may comprise a metallic frame comprised of a series of rigid bars that form a rectangular, octagonal, circular, or other geometric shape that is configured to rest adjacent to the ground surface.

In addition, the devices include a motor 12 that is connected to and located above (or within the same plane as) the central base 10. The motor 12 is configured to rotate an axis 20 that is perpendicular to the ground surface. In certain preferred embodiments, the motor 12 is an electric motor, such as a 16-volt electric motor 12. In certain preferred embodiments, as described below, the electric motor 12 is operably connected to a wired (or wireless) remote speed control. More particularly, in certain embodiments, the motor 12 may be powered on/off, and its speed may be modulated, through a hard-wired control box 30; whereas, in other embodiments, the motor 12 may be controlled in such manner through a wireless remote that is configured to wirelessly communicate with a receiver that is operably connected to the motor 12.

According to certain preferred embodiments of the present invention, the devices further comprise a plurality of arms 14 extending radially from and connected, directly or indirectly, to the motor 12. For example, the devices may include 2, 3, 4, 5, 6, 7, 8, 9, 10, 11, 12, 13, 14, or more arms 14. In certain preferred embodiments, the devices include eight separate arms 14. Each of the plurality of arms 14 is preferably comprised of a rigid material, such as steel, aluminum, or plastic. Each arm 14 may exhibit the same or a different length. In certain preferred embodiments, however, each arm 14 will exhibit the same (or substantially the same) length, such as between 1 to 8 feet, or between 1.5 to 6 feet, or between 2 to 5 feet, or between 3 to 4 feet. Each of the plurality of arms 14 is connected, directly or indirectly, to the motor 12, such that rotation of the motor 12 causes each of the plurality of arms 14 to simultaneously rotate. For example, each of the plurality of arms 14 may be connected to the axis 20, which in turn is operably connected to the motor 12, whereby operation of the motor 12 causes rotation of the axis 20 that is positioned perpendicular to the ground surface, which in turn causes the connected plurality of arms 14 to rotate in a circular fashion over the ground surface.

According to certain preferred embodiments of the present invention, the devices include a golf tee 16 connected to the distal end of each of the plurality of arms 14, with the motor 12 and axis 20 being configured to simultaneously rotate the plurality of arms 14 and each connected golf tee 16. Importantly, the distal end of each of the plurality of arms 14—where each golf tee 16 is connected—will exhibit a surface that is parallel (or substantially parallel) with the ground surface, such that a golf ball is capable of resting (through gravity force) on the top side of each golf tee 16. The invention provides that the golf tees 16 may be conventional/disposable golf tees (made of wood or plastic) that are configured to be inserted into an aperture located at the distal end of each of the plurality of arms 14. In other embodiments, the golf tees 16 may be durable cylinders that are commonly used on driving ranges, which are affixed to the distal end of each of the plurality of arms 14 and comprised of rubber, elastomers, or other materials. According to certain preferred embodiments of the invention, the rotating golf tee devices preferably include an impact absorbing pad 18 located beneath each golf tee 16, such impact absorbing pad 18 may comprise synthetic grass.

In addition, according to certain preferred aspects of the invention, each of the plurality of arms 14 is connected, directly or indirectly, to the motor 12 at a first position 22 that is elevated above a second position at which each golf tee 16 is connected to the distal end of each of the plurality of arms 14. According to such embodiments, each of the plurality of arms 14 will radially extend from the motor 12/axis 20 at a position that is higher (relative to the ground surface) than the point at which each golf tee 16 is connected to each of the plurality of arms 14.

Still further, according to certain preferred aspects of the invention, the motor 12 is configured to simultaneously rotate the plurality of arms 14 and each golf tee 16 connected to each of the plurality of arms 14 at two or more speeds, with the rotating golf tee device being configured to allow a user to select the desired speed from the two or more speeds. In certain embodiments, the motor 12 is configured to simultaneously rotate the plurality of arms 14 at a first speed of 1 revolution every 10 seconds. Alternatively, the motor 12 is preferably configured to operate at a speed that causes the plurality of arms 14 to complete a full rotation in less than or more than 10 seconds. As explained above, the invention provides that the speed at which the motor 12 operates is preferably modulated by a user of the device through a controller 30 that is connected to (through a hard wire or wireless signal) the motor 12.

In certain preferred embodiments, the rotating golf tee devices may include additional elements that are designed to improve the aesthetics of the devices. For example, the devices may include an external casing 24 that covers the motor 12 and rotating axis 20. Still further, for example, the devices may include an apron 26 that surrounds and covers the central base 10. The apron 26 may be comprised of, for example, a synthetic grass material. Still further, the devices may further include a resting mat 28, e.g., comprised of synthetic grass, which sits on the ground surface adjacent to a golf tee 16 and provides a soft place to rest the head of a golf club during or prior to operation.

Figure 4:
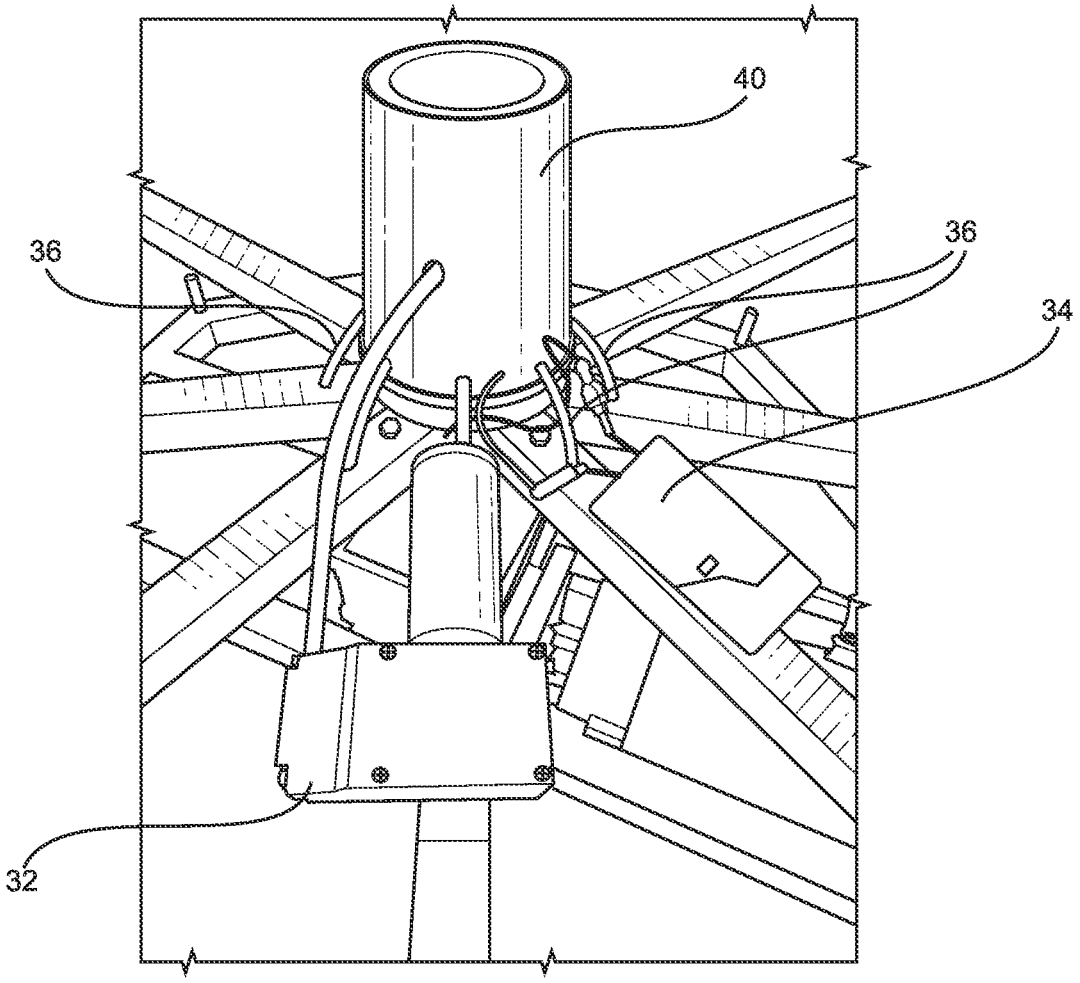
FIG. 4 is a view of the vacuum pump described herein.
Figure 5:
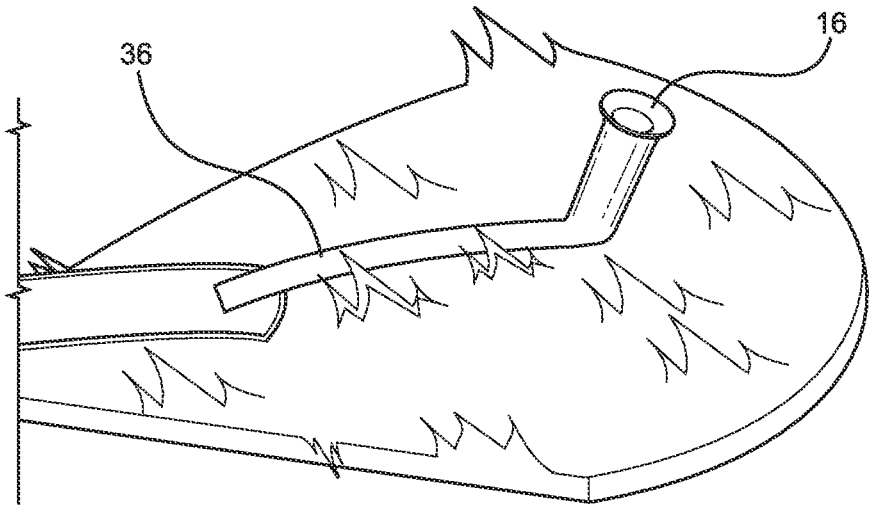
FIG. 5 is a view of a tube that pneumatically connects the vacuum pump to a golf tee.

According to certain embodiments of the present invention, the rotating golf tee devices may further comprise a vacuum pump 32 (FIG. 4). The vacuum pump 32 is operably connected to a power source, such as a battery 34 that is included in the rotating golf tee device. The vacuum pump 32 is pneumatically connected to a series of tubes 36, with each tube 36 traveling along or within one of the plurality of arms 14 and being pneumatically connected to the golf tee 16 at the distal end of the applicable arm 14 (such that each of the plurality of arms 14 and associated golf tees 16 are pneumatically connected to a tube 36 that is pneumatically connected to the vacuum pump 32)(FIG. 5). As used herein, "pneumatically connected" means that the vacuum pump 32, series of tubes 36, and associated golf tees 16 are fluidly connected in a way that the vacuum pump 32 is capable of delivering a suction force to a golf ball resting on the applicable golf tee 16.

The invention provides that the vacuum pump 32 and series of tubes 36 are configured to deliver a suction force to each golf tee 16, to assist in stabilizing a golf ball on the tee 16 as the plurality of arms 14 rotate. In addition, in such embodiments, the rotating golf tee devices may further include an accumulator chamber 40, which is configured to maintain a constant vacuum pressure (suction force) across all of the golf tees 16, even when one or more balls are missing from the tees 16 (which would otherwise create a vacuum leak and affect the suction force being applied to the other golf tees 16). The invention provides that, in these embodiments, the vacuum pump 32 may be a DC 12V pump, having a maximum flow of 15 L/minute and a maximum vacuum pressure of −850 millibars (mbar).

Figure 6:
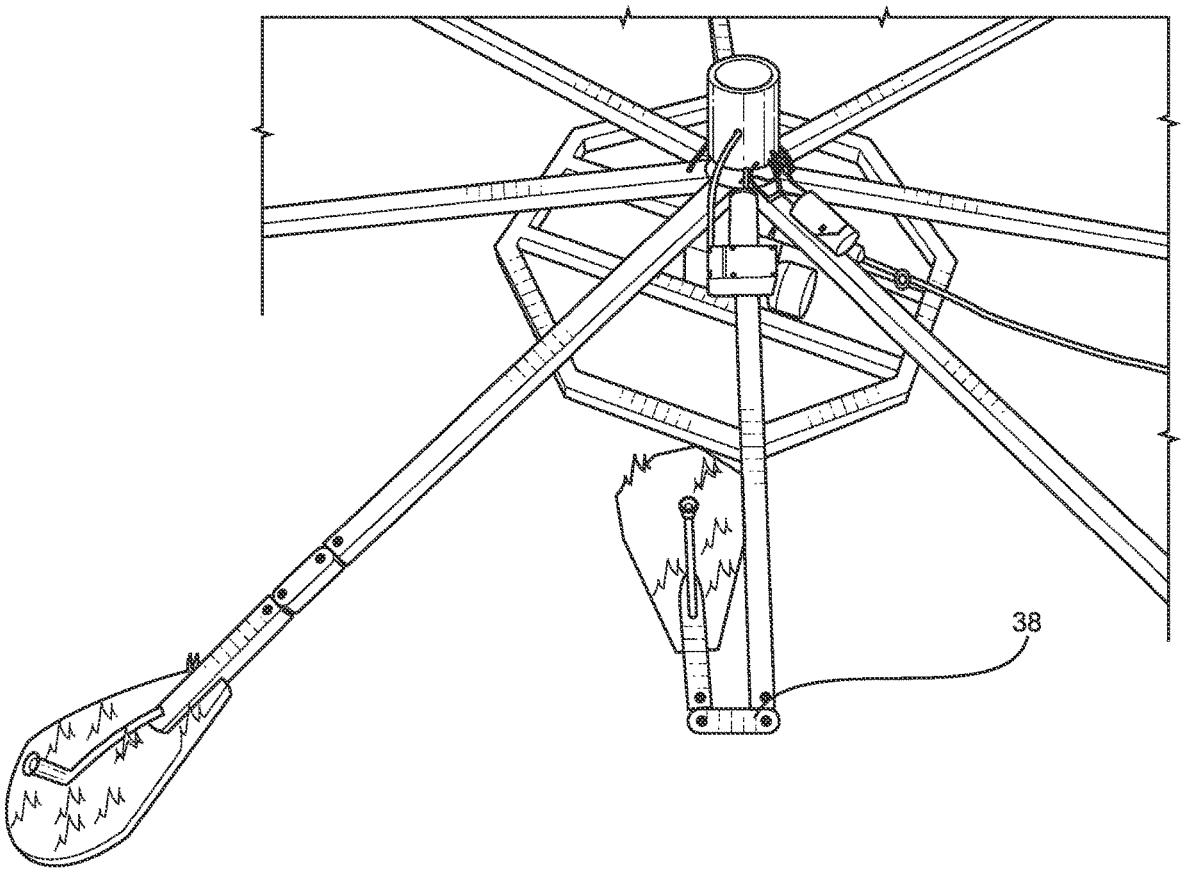
FIG. 6 is a view of the breakaway joint described herein.

According to yet further embodiments, each of the plurality of arms 14 of the rotating golf tee devices may include one or more breakaway joints 38 (FIG. 6). Each breakaway joint 38 may consist of a hinge joint, which is configured to fold the corresponding arm 14 in the direction of a golfer's swing. More particularly, each breakaway joint 38 will fold when and if a golfer accidentally misses the golf ball and strikes the arm 14 with a golf club. The breakaway joint 38 is configured to avoid or minimize damage to the arm 14 and the golfer's club. As shown in FIG. 6, in certain embodiments, two breakaway joints 38 are incorporated into each of the plurality of arms 14, with each breakaway joint 38 consisting of a hinge joint.

Figure 7:
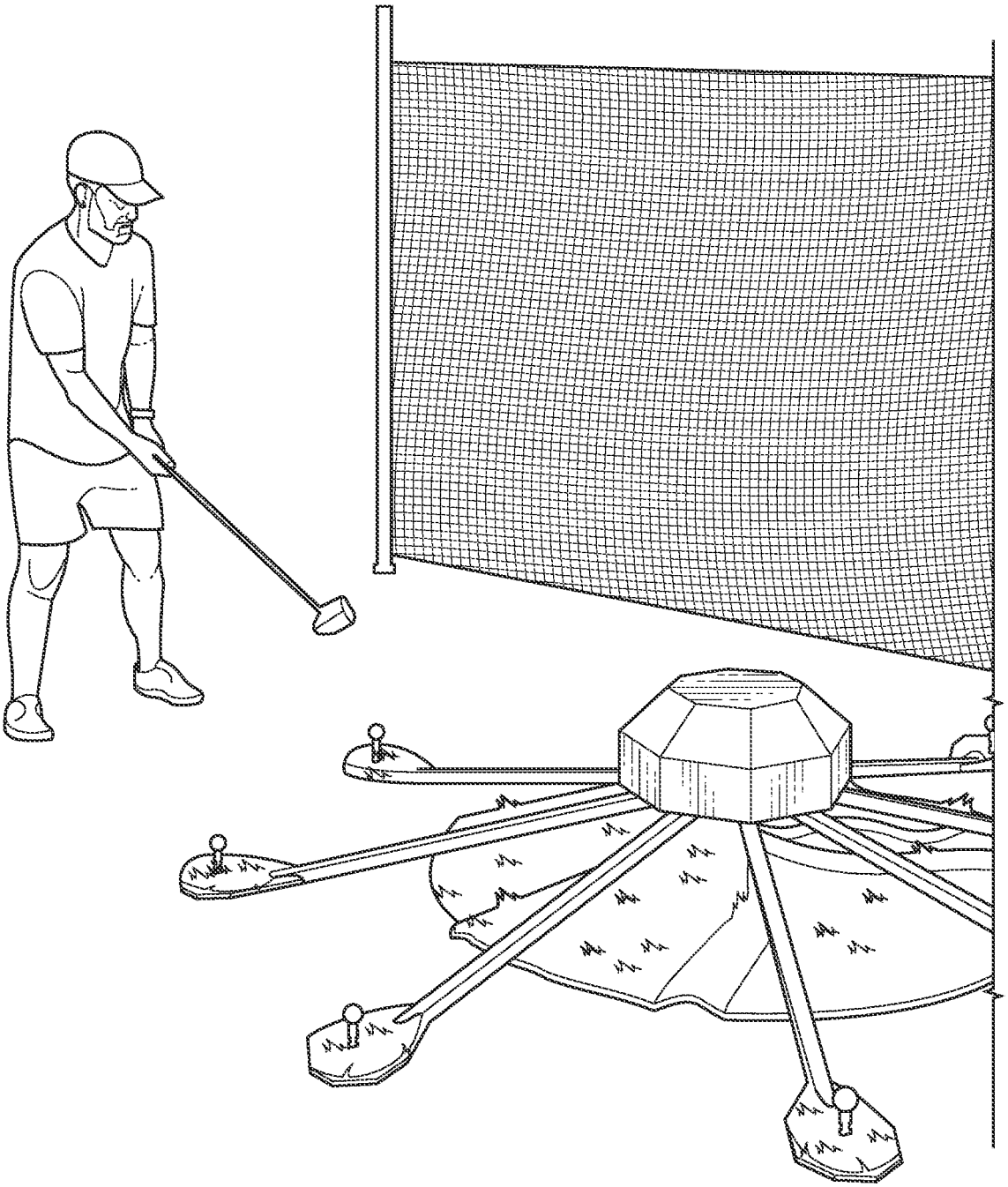
FIG. 7 is a view of the rotating golf tee assembly of the present invention being used by a golfer.

As described herein, during operation, the motor 12 causes the axis 20 (which is oriented perpendicular to the ground surface) to rotate — — which, in turn, causes each of the plurality of arms 14 and each golf tee 16 to simultaneously rotate. As illustrated in FIG. 7, a user of the device may then attempt to strike each golf ball as the device rotates, e.g., striking eight moving golf balls (at a speed of 1 revolution every 10 seconds) presents a fun challenge for golf aficionados and novices alike. The invention provides that the rotating golf tee devices may be used with conventional golf balls—and hit into a driving range, a golf net, a golf simulator, or other safe area. In other cases, the rotating golf tee devices may be used with golf balls comprised of plastic or foam/elastomers, such that the rotating golf tee devices may also be safely used in neighborhood places.

In certain embodiments, the invention provides that the rotating golf tee devices will include a non-human means for placing (and replacing) golf balls on each golf tee 16. The invention provides that such means may place multiple golf balls on the golf tees 16 at the same time—or, alternatively, the means may be configured to place a golf ball on each golf tee 16 is a serial fashion. The means may include electromechanical arms, pneumatic means, or others.

In certain alternative embodiments, the rotating golf tee devices may comprise a rotating platform, with the golf tee 16 positioned around the perimeter thereof. More specifically, in such embodiments, the rotating golf tee devices will include a motor 12, which causes rotation of the axis 20 that is positioned perpendicular to the ground surface. In such embodiments, the axis 20 is connected to a solid and planar surface, such as a circular planar surface. The invention provides that the golf tees 16 will be positioned near the perimeter of the circular planar surface, such that rotation of the circular planar surface will cause the series of golf tees 16 to rotate as described herein. In such embodiments, the invention provides that the motor 12 and axis 20 may be submerged below a ground/floor surface on which a user stands during operation, such that the rotating circular planar surface is contiguous (or approximately contiguous) with the surrounding ground/floor surface on which the user stands during operation.

The many aspects and benefits of the invention are apparent from the detailed description, and thus, it is intended for the following claims to cover all such aspects and benefits of the invention that fall within the scope and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed herein.

What is claimed is:

1. A rotating golf tee device, which comprises:
(a) a central base configured to be positioned on a ground surface;
(b) a motor that is connected to and located above, or within a same plane as, the central base that rotates an axis perpendicular to the ground surface;
(c) a plurality of arms extending from and connected, directly or indirectly, to the motor; and
(d) a golf tee connected to a distal end of each of the plurality of arms, wherein the motor is configured to simultaneously rotate the plurality of arms and each golf tee connected to each of the plurality of arms.

2. The rotating golf tee device of claim 1, which further comprises an impact absorbing pad located beneath each golf tee.

3. The rotating golf tee device of claim 2, wherein the impact absorbing pad comprises synthetic grass.

4. The rotating golf tee device of claim 1, wherein each of the plurality of arms exhibits an identical length.

5. The rotating golf tee device of claim 1, wherein the motor is configured to simultaneously rotate the plurality of arms and each golf tee connected to each of the plurality of arms at two or more speeds, wherein the rotating golf tee device is configured to allow a user to select a desired speed from the two or more speeds.

6. The rotating golf tee device of claim 1, wherein each of the plurality of arms is connected, directly or indirectly, to the motor at a first position that is elevated above a second position at which each golf tee is connected to the distal end of each of the plurality of arms.

7. The rotating golf tee device of claim 1, which further comprises a vacuum pump and a series of tubes, wherein each tube within the series of tubes (a) is pneumatically connected to the vacuum pump at a first end; (b) travels along or within a single arm of the plurality of arms; and (c) is pneumatically connected to the golf tee that is connected to the single arm at a second end, wherein the vacuum pump and the series of tubes are configured to deliver a suction force to a golf ball that is resting on the golf tee.

8. The rotating golf tee device of claim 1, wherein each arm of the plurality of arms includes one or more breakaway joints, wherein each breakaway joint is configured to fold the arm in a direction of a golfer's swing if the golfer's club strikes the arm.

9. A rotating golf tee device, which comprises:
(a) a central base configured to be positioned on a ground surface;
(b) a motor that is connected to and located above, or within a same plane as, the central base that rotates an axis perpendicular to the ground surface;
(c) a plurality of arms extending from and connected, directly or indirectly, to the motor;
(d) a golf tee connected to a distal end of each of the plurality of arms; and
(e) an impact absorbing pad located beneath each golf tee, wherein the impact absorbing pad comprises synthetic grass, wherein:
  (i) each of the plurality of arms is connected, directly or indirectly, to the motor at a first position that is elevated above a second position at which each golf tee is connected to the distal end of each of the plurality of arms; and
  (ii) the motor is configured to simultaneously rotate the plurality of arms and each golf tee connected to each of the plurality of arms at two or more speeds, wherein the rotating golf tee device is configured to allow a user to select a desired speed from the two or more speeds.

10. The rotating golf tee device of claim 9, which further comprises a vacuum pump and a series of tubes, wherein each tube within the series of tubes (a) is pneumatically connected to the vacuum pump at a first end; (b) travels along or within a single arm of the plurality of arms; and (c) is pneumatically connected to the golf tee that is connected to the single arm at a second end, wherein the vacuum pump and the series of tubes are configured to deliver a suction force to a golf ball that is resting on the golf tee.

11. The rotating golf tee device of claim 10, wherein each arm of the plurality of arms includes one or more breakaway joints, wherein each breakaway joint is configured to fold the arm in a direction of a golfer's swing if the golfer's club strikes the arm.

* * * * *